US007492919B2

(12) United States Patent
Engbert et al.

(10) Patent No.: US 7,492,919 B2
(45) Date of Patent: Feb. 17, 2009

(54) METHOD FOR FIXING A DIAPHRAGM IN AN ELECTROACOUSTIC TRANSDUCER

(75) Inventors: Wilmink Engbert, Delft (NL); Aart Zeger van Halteren, Hobrede (NL); Hendrik Dolleman, Assendelft (NL); Paul Christiaan van Hal, Hoorn (NL)

(73) Assignee: Sonion Nederland B.V., Amsterdam (NL)

( * ) Notice: Subject to any disclaimer, the term of this patent is extended or adjusted under 35 U.S.C. 154(b) by 230 days.

(21) Appl. No.: 11/453,358

(22) Filed: Jun. 15, 2006

(65) Prior Publication Data

US 2006/0230598 A1 Oct. 19, 2006

Related U.S. Application Data

(62) Division of application No. 09/958,510, filed as application No. PCT/NL00/00223 on Apr. 5, 2000, now Pat. No. 7,110,565.

(30) Foreign Application Priority Data

Apr. 6, 1999 (NL) ..... 1011733

(51) Int. Cl.
*H04R 25/00* (2006.01)

(52) U.S. Cl. ..... 381/418; 381/398; 381/324

(58) Field of Classification Search ..... 381/396, 381/412, 417, 418, 423, 424, 425, 426, 322, 381/324, 398; 29/594, 609.1; 181/157, 171, 181/172

See application file for complete search history.

(56) References Cited

U.S. PATENT DOCUMENTS

| | | | | |
|---|---|---|---|---|
| 2,794,862 A | | 6/1957 | Tøpholm | 179/114 |
| 2,840,177 A | | 6/1958 | Schoengold | 181/31 |
| 3,560,667 A | | 2/1971 | Carlson | 179/114 |
| 3,573,397 A | | 4/1971 | Sawyer et al. | 179/115 |
| 3,588,383 A | | 6/1971 | Carlson et al. | 179/119 A |
| 3,684,052 A | | 8/1972 | Sotome | 181/32 |
| 3,742,156 A | | 6/1973 | Broersma | 179/119 A |
| 3,935,398 A | | 1/1976 | Carlson et al. | 179/114 A |
| 4,109,116 A | | 8/1978 | Victoreen | 179/107 E |
| 4,122,314 A | * | 10/1978 | Matsuda et al. | 381/425 |
| 4,235,302 A | | 11/1980 | Tsukamoto | 181/172 |
| 4,272,654 A | | 6/1981 | Carlson | 179/119 A |
| 4,312,118 A | | 1/1982 | Saik et al. | 29/594 |
| 4,410,769 A | | 10/1983 | Tibbetts | 179/119 A |
| 4,728,934 A | | 3/1988 | Pfander et al. | 340/407 |
| 5,220,612 A | | 6/1993 | Tibbets et al. | 381/68 |

(Continued)

FOREIGN PATENT DOCUMENTS

| | | |
|---|---|---|
| EP | 0 354 698 | 2/1990 |

(Continued)

*Primary Examiner*—Huyen D Le
(74) *Attorney, Agent, or Firm*—Nixon Peabody LLP

(57) ABSTRACT

An electroacoustic transducer employing a polymer connection for maximizing volume displacement. The transducer includes a diaphragm in a case and means for converting. The diaphragm includes a central portion. The means for converting converts between an electric signal and a vibration of the central portion of the diaphragm or vice versa while the diaphragm is coupled to the case. The central diaphragm has an outer edge, and between the outer edge and the inner wall of the transducer case a capillary space is present in which a polymer is provided as a coupling between the outer edge and the inner wall of the case.

20 Claims, 2 Drawing Sheets

U.S. PATENT DOCUMENTS

| | | | | |
|---|---|---|---|---|
| 6,044,925 | A | 4/2000 | Sahyon | 181/157 |
| 6,078,677 | A | 6/2000 | Dolleman et al. | 381/418 |
| 6,219,432 | B1 | 4/2001 | Fryer et al. | 381/398 |
| 7,110,565 | B1 * | 9/2006 | Engbert et al. | 381/418 |

FOREIGN PATENT DOCUMENTS

| | | |
|---|---|---|
| EP | 0 851 710 A1 | 1/1998 |
| GB | 2 229 339 | 9/1990 |

* cited by examiner

METHOD FOR FIXING A DIAPHRAGM IN AN ELECTROACOUSTIC TRANSDUCER

CROSS-REFERENCE TO RELATED APPLICATIONS

This application is a divisional application of prior U.S. patent application Ser. No. 09/958,510, entitled "Electroacoustic Transducer With A Diaphragm And Method For Fixing A Diaphragm In Such Transducer," filed Jan. 23, 2002, now U.S. Pat. No.7,110,565 now allowed, which is a U.S. National phase of International Application No. PCT/NL00/00233, filed Apr. 5, 2000, which is a complete and foreign application of Dutch Patent Application No. 1011733, filed Apr. 6, 1999, each of which is incorporated herein by reference in their entireties.

FIELD OF THE INVENTION

This invention relates to electroacoustic transducers and methods thereof, and, more particularly, to electroacoustic transducers having a diaphragm and methods for fixing a diaphragm in such transducer.

BACKGROUND OF THE INVENTION

Such transducers are known from EP-A-0851710 and find application especially in hearing aids.

For the proper functioning of such a transducer, various requirements are imposed on the construction of inter alia the diaphragm. On the one hand, the diaphragm must be able to move freely, on the other hand it is, of course, necessary to secure the diaphragm somehow. It is therefore customary to attach the diaphragm by its circumferential edge to a support frame or to the case, whereby the central portion of the diaphragm remains unattached in order to be able to vibrate. Often, between this central diaphragm portion and the edge portion, a transition portion formed as a groove or bellows is included to give the central diaphragm portion as much freedom of vibration as possible.

From EP-A-0851710, it is also known to attach the diaphragm to a film, which film is attached to the case. To this end, the film is folded to enable free movement of the diaphragm. A complete suspension of the diaphragm is necessary to obtain a proper acoustic separation between the volume in the transducer above and under the diaphragm.

From GB-A-2229339 also an electroacoustic transducer with a case comprising a diaphragm produced on a film is known. Around the outer edge of a central diaphragm portion a free strip of film is present. The circumferential outer edge of this film is bended at a right angle with respect to the plane of the central diaphragm portion and the bended portion is glued to the inner wall of the case. As described in EP-A-0851710 this manner of connecting has certain disadvantages.

As already mentioned, an acoustic transducer is applied in, for instance, hearing aids, intended to be positioned in the exterior auditory canal of a person. Hence, there is, within this technical field, a continuous pursuit of ever increasing miniaturization, demanding a great sensitivity of the various applied parts.

Apart from this pursuit of miniaturization, it is desired to enlarge the volume displacement by the diaphragm as much as possible, to which end it is desired that the central diaphragm portion be as large as possible. Additionally, it is desired to keep the costs of manufacturing the construction of the diaphragm as low as possible by applying as few parts as possible.

A drawback of all hitherto proposed manners of connecting a diaphragm to the case is the necessity of different production steps, each involving the possible occurrence of errors, which sometimes can and sometimes cannot be corrected, but always entail additional activities and hence additional costs.

SUMMARY OF THE INVENTION

According to an aspect of the invention, an electroacoustic transducer comprises: a case comprising a lid portion and a dish portion each having an inner wall, an outer wall and end edges connecting these; a diaphragm disposed in the case, comprising a central diaphragm portion comprising a circumferential edge; the central diaphragm portion comprising a circumferential edge; the central diaphragm portion being provided on a film, such that along at least a part of the circumferential edge a free strip of film is present, the central diaphragm portion and the free strip of film being located in the same plane; means for, respectively, converting an electric signal to a vibration of the central diaphragm portion or converting a vibration of the central diaphragm portion to an electric signal, while the edge portion of the diaphragm is connected to a wall portion of the case.

According to another aspect of the invention, an electroacoustic transducer comprises: a case; a diaphragm disposed in the case, comprising a central diaphragm portion and an edge portion extending therearound; means for, respectively, converting an electric signal to a vibration of the central diaphragm portion, or converting a vibration of the central diaphragm portion to an electric signal, while the edge portion of the diaphragm is connected to a wall portion of the case.

An object of the invention is to provide a transducer of the present type and a method for the production thereof, in which the aforementioned drawbacks do not occur. To this end, in a first exemplary embodiment, the invention is characterized in that between the outer circumferential edge of the film and the inner wall of the case a capillary space is present in which a polymer is provided as a connection between the circumferential edge and the inner case wall.

The invention also provides a method for fitting a diaphragm in a case of a transducer of the above-described type, characterized in that the central diaphragm portion is attached to a film, in such a manner that along the outer circumferential edge of the central diaphragm portion a free strip of film remains present and that in a capillary space between the circumferential edge of the film and the inner wall of the case a polymer of low viscosity is provided to connect the film edge to the case wall.

This embodiment of the invention has the advantage that the connection between the case and the diaphragm can be very elastic and therefore does not deform or tear even in the case of extensive deflections. Also, the attachment is completely free of tension, which is very favorable to the acoustic properties of the diaphragm.

The polymer used should in any case have the property that it does not evaporate, does not influence the frequency response of the diaphragm, and is also able to resist particular strains. Polymers meeting these requirements are, for instance, polybutenes of different viscosities.

Another embodiment of the invention is characterized in that the central diaphragm portion comprises an outer edge, that the edge portion comprises a circumferential edge, that is located in the same plane, as the central portion of the diaphragm, spaced apart from the outer edge of the central portion, that the central portion and the circumferential edge consist of the same material and are connected to each other via at least one strip also consisting of this material, and that between the circumferential edge of the diaphragm and the outer edge a capillary space is present in which a polymer is provided as a connection between the circumferential edge and the outer edge.

Additionally, the invention further provides a method characterized in that a diaphragm is formed from a sheet-like material, having a central portion and a circumferential edge located at a capillary distance from the central portion, while between the central portion and the circumferential edge at least one connecting strip is present and that in the capillary space between the central portion and the circumferential edge a flexible polymer is provided.

The aforementioned embodiment has the further advantage that the number of process steps is reduced; that errors can more easily be corrected, in particular before the polymer is provided, and that the diaphragm is suspended very flexibly from the circumferential edge, which is connected to the case, so that forming the suspension, as when a film is used, is no longer necessary. Furthermore, in this embodiment, the diaphragms can be manufactured inexpensively in mass production by means of punching. Automatic assembly of the diaphragms is equally possible.

In still another embodiment, a method is provided for manufacturing an electroacoustic transducer for, for instance, a hearing aid, with a diaphragm arranged in a housing. According to this embodiment, the diaphragm is attached onto a film or punched from a sheet of material, such that along the circumferential edge of the diaphragm, a free strip of film or a strip of material remains present. In a capillary space between the circumferential edge of the film and the inner wall of the housing, or in a capillary space between the diaphragm and the strip of material, a polymer of a low viscosity is provided to connect the diaphragm with the housing wall. Through the aforementioned method, the production of the transducer is greatly simplified.

BRIEF DESCRIPTION OF THE FIGURES

The invention will be further elucidated below on the basis of an exemplary embodiment with reference to the drawings. In the drawings.

DETAILED DESCRIPTION OF THE ILLUSTRATED EMBODIMENTS

Figure 1:
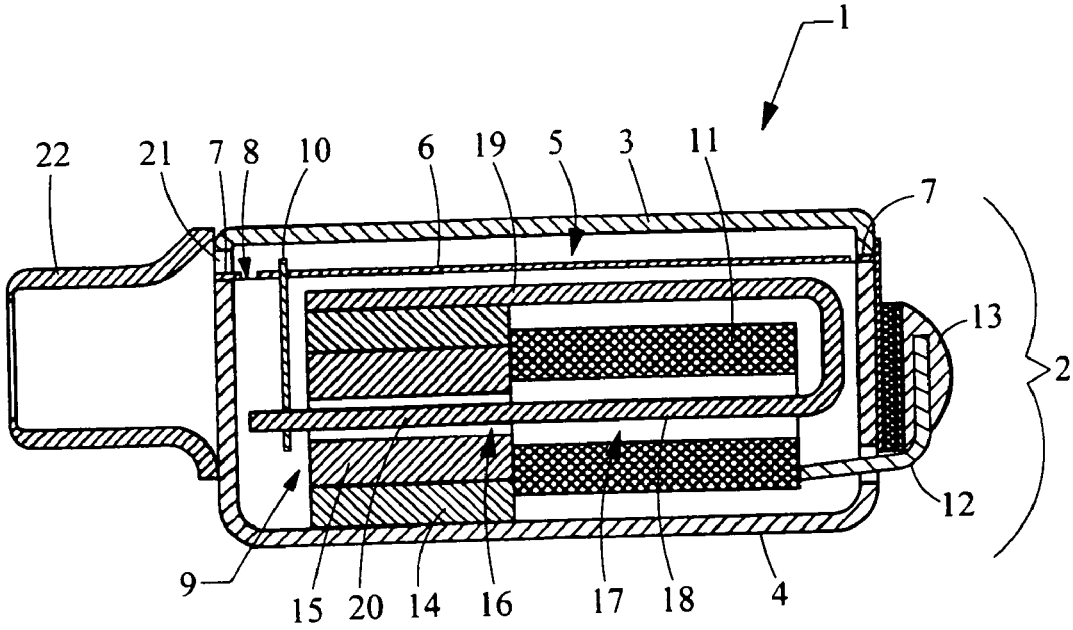
FIG. 1 is a cross-sectional elevation of a transducer with a diaphragm.

The present invention will be briefly explained with reference to FIG. 1, showing a known electroacoustic transducer 1.

The electroacoustic transducer 1 comprises a case 2 consisting of two parts, namely a first case part 3 and a second case part 4. The case 2 is generally shaped as a rectangular box, and the two case parts 3 and 4 generally have a substantially U-shaped cross section, the concave sides of the case parts-3 and 4 facing one another and, when assembled, enclosing the interior of the case 2. In the following, the first case part 3 win also be designated by the term "lid" and the second case part 4 will also be designated by the term "dish".

In the interior of the case 2 a diaphragm 5 is positioned. The diaphragm has a central diaphragm portion 6, and an edge portion 7 extending therearound, intended for fixing the diaphragm 5 to the case 2. Between the central diaphragm portion 6 and the edge portion 7, the diaphragm 5 has a transition portion 8, which may be shaped as a pattern of folds.

Mounted on the dish 4 is an actuator 9, which is coupled by means of a movement transmission member 10, hereinafter referred to as "fork", to the central diaphragm portion 6.

Since the nature and construction of the actuator 9 are no subject matter of the present invention, and the skilled person does not need any knowledge thereof for a proper understanding of the present invention, while moreover use can be made of an actuator known per se, these aspects will only be described briefly. The actuator 9 comprises an electric coil 11 being connected by means of an electric wire 12 extending through the dish 4, to terminals 13 mounted on the outer surface of the case 2. In a magnet housing 14 a magnetic element 15 is arranged. An air gap 16 of the magnetic element 15 is aligned with an air gap 17 of the coil 11. A U-shaped armature 18 has a first leg 19 being connected to the magnet housing 14 and a second leg 20 extending in the air gaps 16 and 17 which are in alignment with each other. Connected to the end of the second armature leg 20 is the fork 10.

When an externally generated current is presented to the coil 11, a force is applied to the armature 18 by an interaction between the fields generated by the magnetic element 15 and the coil 11. Thus, a displacement is generated in the longitudinal direction of the fork causing the diaphragm to vibrate in order to generate a pressure wave.

The lid 3 has an opening 21, through which the interior of the case 2, located between the lid 3 and the diaphragm 5, communicates with the exterior world. Connected to the case is a substantially cylindrical snout 22, to which, if so desired, a flexible tube can be connected for conducting pressure waves.

As is shown in FIG. 1, in the electroacoustic transducer 1, the edge portion 7 of the diaphragm 5 is positioned in a plane parallel to the plane defined by the central diaphragm portion 6.

The edge portion 7 of the diaphragm 5 is fixed, for instance by way of gluing, to the free end edges of the side walls of the dish 4. These free end edges define a surface which is suitable for attaching the edge portion 7 of the diaphragm 5, and whose width is defined by the thickness of the side walls of the dish 4. Such method of connecting the diaphragm is known from EP-A-0851710.

According to the invention, a flexible polymer can be provided in a capillary space between the edge portion or the circumferential edge 7 of the diaphragm 5 and the inner wall of the case 4 to attach the circumferential edge 7 and thus the diaphragm 5 to the dish 4 of the case.

Figure 3:
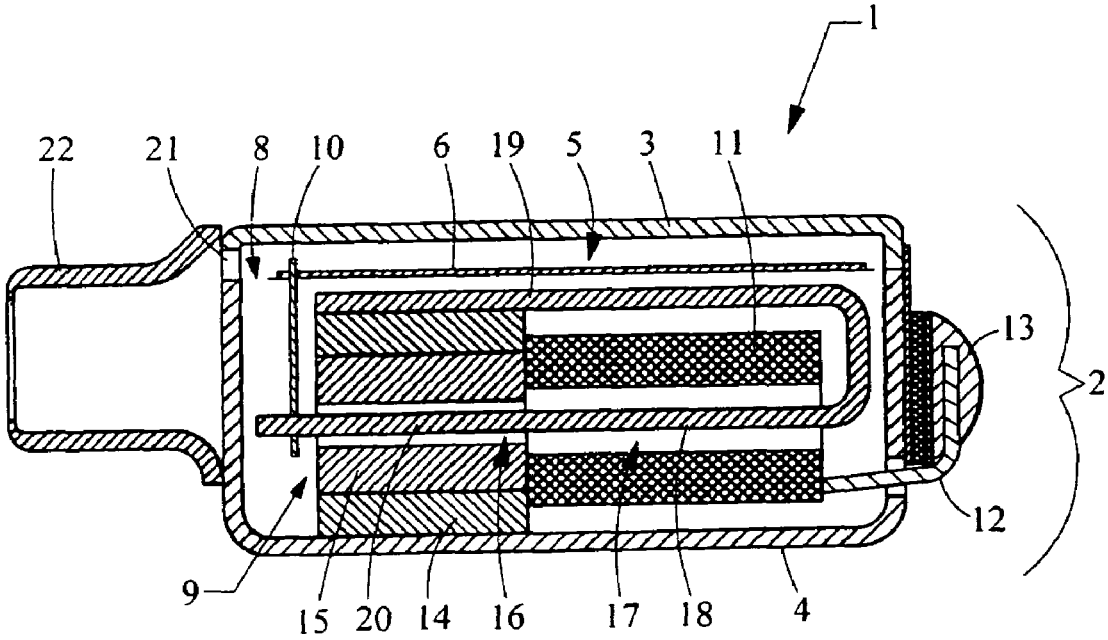
FIG. 3 is a cross-sectional elevation of a transducer with a diaphragm according to an embodiment of the invention.

In the first embodiment of the invention, the central diaphragm portion 6 is attached to a film and a polymer is provided in a capillary space between the outer edge of the film and the case wall. This embodiment is shown in FIG. 3, and the construction is virtually the same as that in the construction in FIG. 1, the only difference being that there is no diaphragm portion between the lid and the dish of the transducer case.

Figure 2:
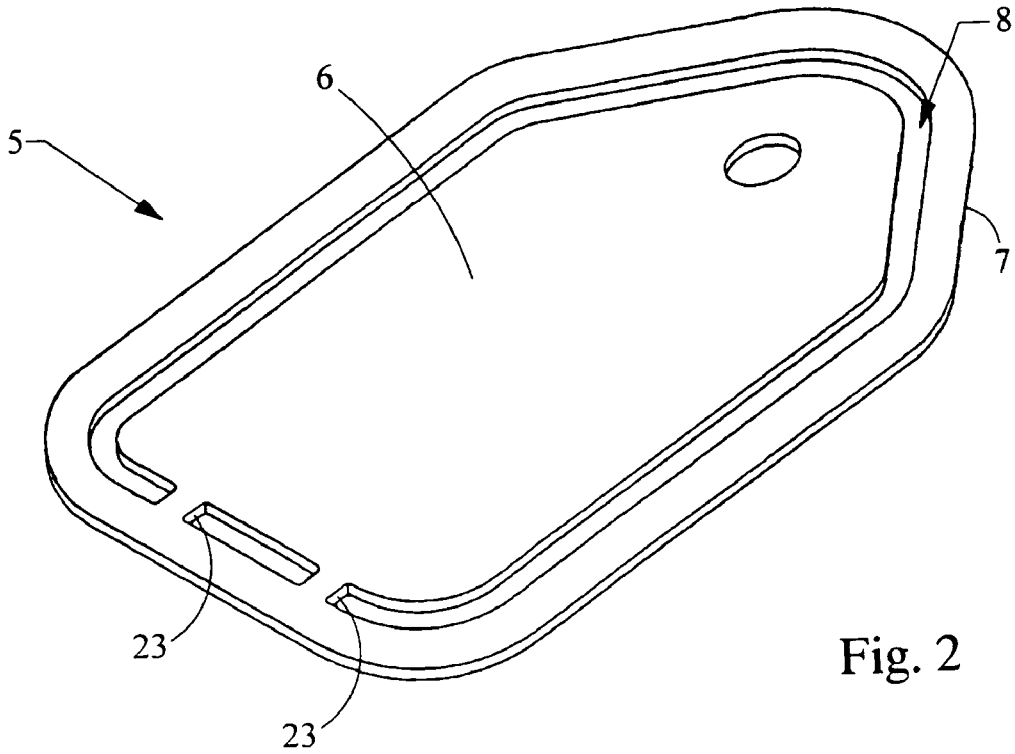
FIG. 2 is a perspective view of a diaphragm according to the invention.

FIG. 2 schematically shows a diaphragm according to a second embodiment of the invention, such as it can be applied in the transducer according to FIG. 1. The central diaphragm portion 6 and the circumferential edge 7 are connected to one another by means of one or more connecting strips or bridges 23. The diaphragm 5 can be simply punched out of a sheet of material, for instance aluminum. The central portion is freely movable relative to the circumferential edge. In the capillary interspace 8 the flexible polymer is provided. In this embodiment, the diaphragm can, if so desired, be connected with its edge portion between the free end edges of the lid 3 and dish 4.

What is claimed is:

1. A method for manufacturing a transducer, comprising the steps of:

providing a case having an inner wall portion;

forming a diaphragm assembly, said diaphragm assembly including a central diaphragm portion having a circumferential edge;

disposing into said case said diaphragm assembly such that said circumferential edge of said central diaphragm assembly and said inner wall portion of said case have a capillary space therebetween; and providing a polymer in said capillary space to connect said diaphragm assembly to said inner wall portion.

2. The method of claim 1, wherein said forming includes attaching said central diaphragm portion to a film having an outer circumferential edge, and dimensioning said central diaphragm portion to leave a free strip of film along at least a portion of said circumferential edge of said film.

3. The method of claim 2, wherein said capillary space is formed by folding a portion of said film along said outer circumferential edge of said film.

4. The method of claim 2, wherein said polymer is a flexible polymer and wherein said forming includes:

providing a sheet of material; and removing selected areas of said sheet to define said central diaphragm portion, a circumferential area surrounding said central diaphragm portion, and at least one connecting bridge connecting said central diaphragm portion to said circumferential area.

5. The method of claim 4, wherein said central diaphragm portion and said circumferential area are substantially coplanar.

6. The method of claim 2, wherein said central diaphragm portion and said free strip of film are substantially coplanar.

7. The method of claim 2, wherein said outer circumferential edge of said film engages said case.

8. The method of claim 1, wherein said forming includes the steps of:

providing a sheet of material; and removing selected areas of said sheet to define said central diaphragm portion, a circumferential area surrounding said central diaphragm portion, and at least one connecting bridge connecting said central diaphragm portion to said circumferential area.

9. The method of claim 8, wherein said central diaphragm portion and said circumferential area are substantially coplanar, and wherein said polymer is a flexible polymer having a low viscosity, does not influence a frequency response of said diaphragm assembly, and said flexible polymer increasing resistance to deformation of said diaphragm when subjected to a sound.

10. The method of claim 1, wherein said polymer is polybutene.

11. The method of claim 1, wherein said polymer is a flexible polymer having a low viscosity.

12. A method for manufacturing a transducer, comprising the steps of:

providing a case having an inner wall portion;

forming a diaphragm assembly, said diaphragm assembly including a generally planar central diaphragm portion having a circumferential edge;

disposing into said case said diaphragm assembly such that at least a portion of said circumferential edge of said central diaphragm assembly and a portion of said inner wall portion of said case define a capillary space therebetween; and providing a polymer in said capillary space to connect said diaphragm assembly to said inner wall portion, said polymer increasing resistance to deformation of said central diaphragm portion when subject to a sound.

13. The method of claim 12, wherein said forming includes:

attaching said central diaphragm portion to a film having an outer circumferential portion, said outer circumferential portion engaging said case; and disposing said central diaphragm portion on said film and dimensioning said diaphragm portion to leave a free strip of film, said outer circumferential portion being said free strip of film.

14. The method of claim 13, wherein said capillary space is a fold in said film.

15. The method of claim 13, wherein said polymer is a flexible polymer having a low viscosity.

16. The method of claim 12, wherein said polymer is polybutene.

17. The method of claim 12, wherein said forming includes:

providing a sheet of material; and removing selected areas of said sheet to define said central diaphragm portion, an edge portion surrounding said central diaphragm portion, and at least one connecting bridge connecting said central diaphragm portion to said edge portion, said edge portion being substantially coplanar with said central diaphragm portion.

18. The method of claim 17, wherein said edge portion and said central diaphragm portion are aluminum.

19. The method of claim 17, wherein said case includes a lid portion and a dish portion, and said edge portion of said diaphragm assembly is connected between said lid portion and said dish portion.

20. The method of claim 12, wherein said forming includes:

providing a sheet of material;

removing selected areas of said sheet to define said central diaphragm portion, an edge portion surrounding said central diaphragm portion, and at least one connecting bridge connecting said central diaphragm portion to said edge portion, said edge portion being substantially coplanar with said central diaphragm portion;

attaching said central diaphragm portion to a film having an outer circumferential portion, said outer circumferential portion engaging said case; and disposing said central diaphragm portion on said film and dimensioning said diaphragm portion to leave a free strip of film, said outer circumferential portion being said free strip of film;

wherein said case includes a lid portion and a dish portion, and said edge portion of said diaphragm assembly is connected between said lid portion and said dish portion, said polymer has a low viscosity, and said edge portion and said central diaphragm portion are aluminum.

* * * * *